United States Patent [19]

Nason

[11] 4,005,737

[45] Feb. 1, 1977

[54] WINDOW SCREEN ASSEMBLY TOOL

[76] Inventor: Robert W. Nason, 2706 E. 112th St., Lynwood, Calif. 90262

[22] Filed: Jan. 2, 1976

[21] Appl. No.: 646,381

[52] U.S. Cl. ..... 140/109; 29/235

[51] Int. Cl.[2] ..... B21F 33/02

[58] Field of Search ..... 140/107, 108, 109; 29/235

[56] References Cited

UNITED STATES PATENTS

| | | | |
|---|---|---|---|
| 739,343 | 9/1903 | Peregrine | 140/109 |
| 905,917 | 12/1908 | Perkins | 140/109 |
| 1,556,234 | 10/1925 | Maise | 29/235 |
| 3,077,907 | 2/1963 | Gottlieb | 140/109 |

*Primary Examiner*—Lowell A. Larson
*Attorney, Agent, or Firm*—Marden Gordon

[57] ABSTRACT

A tool for the assembly of screens to windows consisting of a table or bench top for mounting the tool thereon, a gear train mountable to the edge of the bench or table, a hand driven gear for manually and positively driving the assembly tool along the gear train, a housing enclosing the manually driven gear with a shaft affixed to and protruding from the top of the housing for adjustable assembly of the screen assembly mechanism, adjustable vertical and horizontal shafts for alignment of the tool to the window screen, and a wheel moveable about the perimeter of the window screen to apply pressure to the flexible tube for binding of the screen within the window frame, this same tool being usable for the assembly of screens to windows or to doors.

1 Claim, 3 Drawing Figures

WINDOW SCREEN ASSEMBLY TOOL

BACKGROUND OF THE INVENTION

1. Field of the Invention

This invention relates to a screen assembly tool for the assembly of screens to windows or doors.

2. Description of the Prior Art

It has always been a tedious chore in the construction field to apply screens to windows or door frames, this activity being time consuming due to the use of conventional or make-shift hand tools. At the present time, screens are normally assembled to screen frames by cutting a piece of screen to the frame size, then placing the cut screen over the frame opening, and then forcing a length of rubber or plastic tubing along the perimeter of the cut screen into the grooves built within the frame to wedge the tubing and screen in place within the frame, this typically being accomplished with the use of a conventional hand tool, such as a screwdriver, or a hand-held rolling tool. Present methods of assembling screens to screen frames are especially time consuming when necessary to construct a volume of screen windows or doors or in replacing or repairing a number of the same.

SUMMARY OF THE INVENTION

The present invention provides a novel tool for the assembly of screens to windows or doors with a consistent amount of force being applied to press the tubing in the screen frame along the perimeter of the screen, the tubing being pressed into place with a positively guided roller.

It is a feature of the present invention to provide a tool for the assembly of screens to doors and windows.

A further feature of the present invention provides an assembly tool for the assembly of screens to windows or doors which is easy to use and reliable and efficient in operation.

Yet still a further feature of the present invention provides a screen assembly tool which is of a rugged and durable contruction and which, therefore, may be guaranteed by the manufacturer to withstand rough usage.

Other features of this invention will be apparent during the course of the following description.

BRIEF DESCRIPTION OF THE DRAWINGS

In the accompanying drawings forming a part of this specification, and in which like reference characters are employed to designate like parts throughout the same.

DESCRIPTION OF THE PREFERRED EMBODIMENT

Figure 1:
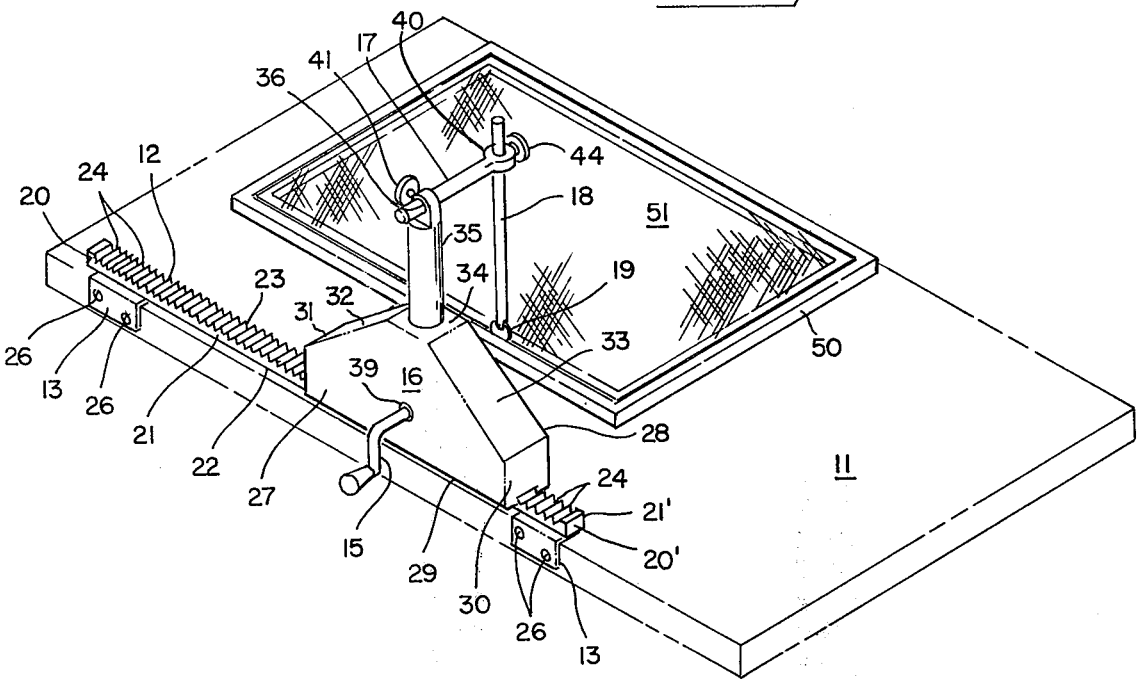
FIG. 1 is a perspective view of the window screen assembly tool mounted to a bench or table top in the process of assembling a screen to a screen frame.
Figure 2:
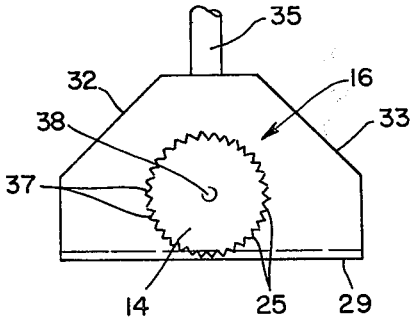
FIG. 2 is an internal cut-away view of the drive gear within its housing.
Figure 3:
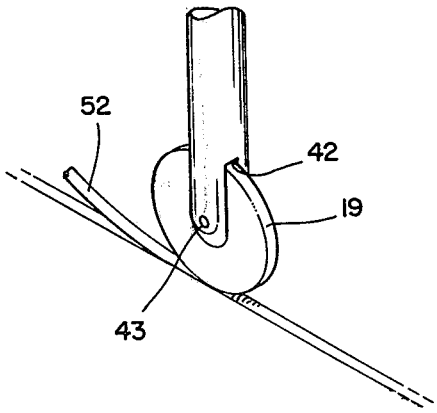
FIG. 3 is a perspective view of the roller wheel applying pressure to the tubing for mounting of a screen within its frame.

Referring now to the drawings in detail, there is illustrated a preferred form of the window screen assembly tool constructed in accordance with the principles of the present invention and which is designated generally in its entirety by the reference numeral 10 and which is comprised of a bench or table top 11, a gear train 12, gear train mounting brackets 13, a drive gear 14, a drive gear handle 15, a drive gear housing 16, a vertical adjustable shaft 17, a horizontal adjustable shaft 18, a pressure roller 19, and associated bolts and components as will be later described.

The bench or table top 11 is a conventional wood or metal top and is included in the description of this invention merely to show the mounting of the window screen assembly tool and the position of the screen and screen frame relatively thereto. The gear train 12 is constructed of durable material, such as steel or high density plastic, and is generally rectangular in shape having two end walls 20 and 20', two side walls 21 and 21', a bottom surface 22, and a top surface 23 with a series of gear teeth 24 formed along the width of the entire top surface 23 to match the gear teeth 25 in the drive gear 14. Typical dimensions of the gear train would be with the bottom surface 22 and the top surface 23 approximately 36 inches long by 2 to 3 inches wide, the side walls 20 and 21' also being approximately 36 inches long by approximately 1 inch high, and the end walls 20 and 20' being of 2 to 3 inches wide by approximately 1 inch high. The gear train 12 is provided with mounting brackets 13 securely affixed to the bottom surface 22 with at least two mounting brackets 13 being assembled thereto near the end walls 20 and 20', the gear train mounting brackets 13 also being of rigid material formed in the shape of an L with one leg of the L being securely attached to the bottom surface 22 of the gear train 12 with the second leg of the L being turned downwardly and perpendicularly to the first leg and being provided with mounting holes 26 in each of the mounting brackets 13. Conventional screws, bolts, or nails (not shown) are driven through the mounting holes 26 into the side of the bench or table top 11 for securely mounting the gear train 12 on the top thereof.

The drive gear housing 16 in constructed of durable material, such as cold rolled sheet steel or high density plastic, and consists of two side walls 27 and 28 which are long at the bottom surface 29 and are joined on each end by side walls 30 and 31 which are wide enough to span the gear train 12 and perpendicularly space apart the side walls 27 and 28 for a short vertical distance from the gear train 12 with the equally wide side walls 32 and 33 obliquely being connected to the top of the side walls 30 and 31 and to opposite sides of the top surface 34. The vertical shaft 35 is comprised of a cylindrical length of durable material, such as cold rolled steel or high density plastic, and is rigidly affixed at its bottom to the center of the top surface 34 and is provided at its top with a round hole 36 for assembly of the vertical adjustable shaft 17 thereto.

The drive gear 14 consists of a round plate of durable, such as steel or high density plastic, and is provided with the gear teeth 37 hobbed around its circumference to match the teeth of the gear train 12. A center round hole 38 is provided in the drive gear 14, the handle 15 being assembled through the round hole 39 in the side wall 27, through the round hole 38 in the drive gear 14 and through a similar hole (not shown) in the side wall 28. The handle 15 is secured to each of said holes in a conventional manner (not shown), such as by the use of C-washers, E-rings, etc.

The vertical adjustable shaft 17 is constructed of durable material, such as cold rolled steel, and is a length of cylindrical shaft being provided on one end with a ring 40 with its blunt end fitting through hole 36 in the top of the vertical shaft 35 and is slidably adjustable in or out of hole 36 and is secured in the desired position by means of bolt 41 which is threadably screwed through the top of shaft 35 to apply pressure against the vertical adjustable shaft 17 (the threaded hole and threads on the bolt not shown). The horizontal adjustable shaft 18 is also constructed of durable material, such as cold rolled steel, and is a length of cylindrical shaft being blunt on the top surface and provided with a slit or notch 42 on the bottom end and with the through holes 43 being provided at the bottom of the notched portion 42. The pressure roller 19 is a small round cylindrical plate having center holes (not shown) that align with the through holes 43 for the assembly of a pin or axle therethrough (also not shown) for assembly of the pressure roller 19 to be rigidly secured, but freely rotatable, within the notch 42. The top end of the horizontal adjustable shaft 18 slips through the center hole in the ring 40 and is adjustable in and out in a vertical direction, being secured in place by a conventional bolt 44 (the threaded hole in the ring 40 and the threaded portion of the bolt 44 not being shown).

In operation, the screen assembly device 10 is mounted on one side of a bench or table top 11 by securely attaching the gear train mounting brackets 13 to the side of the bench or table top 11 by means of conventional screws or nails through the mounting holes 26. The door or window frame 50 is laid flat on top of the bench or table top 11 so that one of its sides is positioned parallel to and along the length of the gear train 12, the screen material 51 is pre-cut for the given door or window frame 50 and is placed inside the frame its outside edges lined up to the inside of the frame 50, a length of tubing 52 is layed in position along one edge of the screen 51 and the side of the frame 50 which is parallel to the gear train 12. The vertical adjustable shaft 17 is adjusted for proper distance through the round hole 36 in the vertical shaft 35 and is secured in place by the bolt 41, and the horizontal adjustable shaft 18 is manually forced downwardly to apply the desired force of the pressure roller 19 against the tubing 52 and the horizontal adjustable shaft 18 is then securely locked placed within the ring 40 by means of the bolt 44. To attach the screen to the frame, the user then turns the handle 15 to turn the drive gear 14, thereby moving the drive gear housing 16, the vertical adjustable shaft 17, and the horizontal adjustable shaft 18 with the pressure roller 19 along the side of the frame 50 to press the tubing 52 and the edge of the screening 51 into place. The procedure described above is then repeated for the assembly of all sides of the screen 51 to the door or window frame 50.

It is to be understood that the form of this invention as shown and described is to be taken as a preferred example thereof, and that this invention is not to be limited to the exact arrangement of parts described in the description or illustrated in the drawings as changes thereto in the details thereof pertaining to size, shape and arrangement of parts thereof are envisioned within the scope of the invention without departing from the novel concepts of the invention.

I claim:

1. A window or door screen assembly tool for the assembly of screens to windows or doors, the tool comprising, in combination:

a gear train with mounting brackets for securement of said gear train to the side of a bench or table top, a drive gear secured within a housing by means of a handle affixing said drive gear within the housing and said handle protruding outwardly of said housing, a round shaft securely affixed to the center of the top of said housing and provided with a round hole at the top of said shaft, vertical and horizontal adjustable shafts for positioning of a pressure roller outwardly and downwardly from said housing for proper alignment of said pressure roller to a window or door frame and so as to apply proper pressure on said pressure roller for the assembly of tubing for attachment of a screen to a screen frame; and said housing consisting of side walls with a flat elongated bottom surface, said side walls being spaced equally distant to each other in the same plane by means of two vertical and perpendicular side walls, two side walls at an oblique angle to cover said drive gear, a short top wall being parallel to the bottom surface with a round shaft being securely affixed to the center of said top surface, and with said shaft being provided with a round hole near its top and with a through threaded hole through its circumference for assembly of a threaded bolt therethrough.

* * * * *